United States Patent [19]

Hardin

[11] Patent Number: 4,672,894

[45] Date of Patent: Jun. 16, 1987

[54] HIGH ROTATIONAL SPEED AUTOREVERSING AXIALLY OSCILLATING INK ROLLER

[76] Inventor: Philip J. Hardin, 850 Park La., Elm Grove, Wis. 53122

[21] Appl. No.: 835,231

[22] Filed: Mar. 3, 1986

[51] Int. Cl.[4] ..... B41F 31/14; B41F 31/26; B41L 27/28

[52] U.S. Cl. ..... 101/348; 101/DIG. 14

[58] Field of Search ..... 101/DIG. 14, 348, 349, 101/350–352, 205–209, 352, 354, 355–358, 360, 361

[56] References Cited

U.S. PATENT DOCUMENTS

| | | | |
|---|---|---|---|
| 1,415,480 | 5/1922 | Ramsaier | 101/348 |
| 1,726,559 | 9/1929 | Halpern | 101/DIG. 14 |
| 2,745,343 | 5/1956 | Davis | 101/DIG. 14 |
| 4,509,426 | 4/1985 | Hardin | 101/348 |

*Primary Examiner*—J. Reed Fisher

*Attorney, Agent, or Firm*—Fuller, Puerner & Hohenfeldt

[57] ABSTRACT

A cylindrical ink roller sleeve is mounted on a fixed shaft for sliding axially on and rotating on the fixed shaft. Left and right hand twist helical grooves or internal threads are formed in a driver cylinder concentric with the inside of the roller sleeve. A control shaft is mounted on said fixed shaft for sliding axially in opposite directions to right and left limits. Prongs on opposite ends of the control shaft are displaced 90° about its axis so prongs at one end engage a helical groove of one twist while the prongs on the other end are turned out of engagement with the helical groove of opposite twist. Engagement will cause the roller to drive in one axial direction or the other until strikers disengage one and engage the other at the limit of axial travel. Then one or two idle revolutions occur and the roller dwells in its axial movement until the control shaft shifts to a limit stop in which case the roller beings to shift in the opposite direction. The idle revolutions eliminate the stress that would occur if reversal occurred instantaneously.

9 Claims, 10 Drawing Figures

HIGH ROTATIONAL SPEED AUTOREVERSING AXIALLY OSCILLATING INK ROLLER

BACKGROUND OF THE INVENTION

The invention disclosed herein is for obtaining uniform distribution of printer's ink on rollers that apply ink to photolithograph image plates such as are used in offset printing presses. A major problem in offset printing presses is to get uniform and consistent distribution of the ink film on the image plates. Non-uniformities result in ghosts appearing in the printed impression which are particularly noticeable in large areas that have dense coloration. In an attempt to minimize this problem, prior printing presses have-arranged a large number of cylindrical rollers whose peripheries are in tangential contact with each other. The assembly of mutually contacting rollers is called an inker. At least one of the rollers is in tangential contact over its length with another roller that rotates in an ink bath and gets a heavy coating of ink on it. The next roller pressing against the roller in the ink bath, called the ductor roller, picks up a thinner coating of ink and transfers it to the series of rollers which, in turn, transfer and spread the ink from one to another until at the end of a series a thin and hopefully uniform coating is applied to the last stage of the rollers which are called the form rollers. The form rollers make tangential contact with the image plates on the plate cylinder and, thus, deposit an ink film of one color on the image plates. As the plate cylinder rotates, it transfers the impression to a blanket cylinder for further transfer of printing on the paper sheet or web. An impression cylinder presses the paper against the blank cylinder.

A prior art practice for improving the uniformity of the ink coating on the form roller is to have at least one of the rollers in the series that contacts one or more of the other rollers oscillate in opposite axial directions which augments forming a uniform film of ink on the rollers. Until recently, oscillating ink rollers were driven axially by wobble plates and cams and swinging arms acting on the end of the shaft on which the rollers rotate. Because of the amount of space that the driving mechanism required, it was not always possible to locate the axially reciprocating rollers in the most advantageous position among the series of rollers.

The most advanced form of axially reciprocating ink roller is described in U.S. Pat. No. 4,509,426 which issued on Apr. 9, 1985 to the inventor in this application. The roller described in this patent rotates and slides axially in opposite directions on a stationary shaft. The mechanism for bringing about reversals in the axial direction of travel is entirely enclosed within the ink roller itself. In this patent, a cylindrical sleeve is fitted inside of the ink roller cylinder. About half the length of the interior of the sleeve contains a helical groove or thread which is like a left hand thread and the other half of the sleeve contains a right hand helix or thread. The ink roller is driven rotationally about its axis by a tangentially contacting adjacent roller which is power driven or receives its rotational force from other rollers in the inker series. Two prong elements are located within the internally threaded sleeve. One prong element is caused to engage the left hand helix so as to drive the roller in one axial direction to a predetermined limit. When this limit is reached, the first prong element is disengaged from the left hand helix or thread and the other prong element is engaged with the right hand helix or thread to cause the roller to reverse its axial direction abruptly until a repetition of the cycle takes place.

Rollers of the type described in the cited patent have, by way of industrial application, proved that they are capable of reducing ghosts and other artifacts by obtaining more uniform distribution of ink through the inker system down to the axially oscillating rollers. The patented axially oscillating roller is effective to smooth the ink on the image plates to eliminate the ink mottling which occurs with prior art rollers due to stickiness between the roller and plate. Use of the form rollers described in the patent has been limited, however, to relatively slow speed presses adapted to print on sheets of paper as opposed to a continuous web. Presses of this type pass sheets through at about 600 lineal feet per minute. Just by way of example, if the roller has a diameter of four inches, it will have a rotational speed of about 573 rpm. Assuming that the pitch of the right and left hand threads or helixes is $\frac{1}{4}''$, to obtain a shift of two inches to the left and back two inches to the right, sixteen revolutions of the roller will occur. And there will be about 72 direction changes per minute. A roller having an internally threaded sleeve can be designed with sufficiently low mass so that the almost instantaneous reversals do not set up noticeable shock or vibrations and do not put such strain on the parts that they break or wear out prematurely. However, it appears that the reversing roller described in the cited patent must be restricted to use in relatively slow presses in which the sheets to be printed move at not much more than 600 feet per minute.

Applying the patented oscillating roller design to inker systems used in printing presses which print on a continuous web instead of sheets would appear to be difficult if not impossible because the lineal speed of the web in the fastest presses at the present time can be around 2,000 feet per minute. Assuming the same design parameters as were assumed for the low speed press just discussed, the number of direction changes by the oscillating roller would be in the vicinity of 252 per minute. Even with the mass of the roller and the helical sleeve minimized, the inertia could be great enough to produce a noticeable shock and a concomitant tendency to damage the parts. Reversals are reduced by about 25% with the improved roller described herein.

The invention involves improvements in the reciprocating mechanism which make the autoreversing axially reciprocating ink roller usable in very high speed presses where many axial motion reversals occur in one second.

SUMMARY OF THE INVENTION

An object of the present invention is to provide an improved axially oscillating ink roller wherein the effects of sudden axial direction reversals are largely minimized or negated.

Another important object is to provide an oscillating ink roller which can be run in either direction of rotation in the inker of a printing press.

In accordance with the invention; the oscillating ink roller is comprised of an outer cylinder or roller on which ink is spread and distributed. It is driven rotationally by tangential contact with another ink coated roller that is being driven rotationally. A cylindrical driver sleeve of a light weight and strong material is fitted concentrically inside of the cylinder. As in the cited patent, the driver sleeve inside of the roller has an internal helical groove or thread which is divided into two coaxial sections. One section, running from one end of the driver sleeve to the middle is a left hand helical groove or thread and the other section, running from the other end to the middle of the driver sleeve is a right hand helical groove or thread. The ink roller and driver sleeve rotate about a non-rotating shaft that typically extends across the width of the press in parallel with other rollers in the inker set. In about the middle of the length of the ink roller, about half the diameter of the stationary shaft is cut away to create a flat area. There are bearing posts mounted to the generally flat area on the shaft that is thus created. A short lost motion control shaft is mounted in the bearing posts for shifting by a limited amount in opposite axial directions parallel to the stationary shaft and to the axis of helically grooved driver sleeve. There are follower members fastened at opposite ends of the lost motion control shaft. The follower members have a pair of radially extending diametrically opposite prong elements. The prong element pair on one follower element is disposed orthogonally about the shaft axis relative to the other prong element pair so one pair will register in the left hand helical groove and the other will register alternately in the right hand helical groove and vice versa in response to 90° rotational steps of the control shaft. Thus, in effect, the helix turns or screws on the engaged prongs and advances the roller axially in one direction and when it reaches its limit, strikers fixed in the helical grooves rotate the prongs on the engaged follower element out of engagement and the prongs on the other follower element into engagement with the helical groove or thread of opposite hand so the roller will shift in the opposite axial direction.

The improvement over the prior patent, and the solution to the problem of shock development due to the rapid reversely of axial direction of the ink roller in high speed presses, results, in accordance with the invention, from letting the roller make one or two revolutions immediately after it runs to its limit in one axial direction which revolutions provide for letting the roller dwell or idle without any axial movement for a moment. This results in a smooth transition from the roller shifting axially in one direction to the opposite direction. The idle or dwell revolution or revolutions are accomplished by causing the control shaft to begin to yield axially as soon as the follower prongs become engaged in the helical groove which will cause the roller to be driven in the opposite direction. The control shaft shifts until it abuts the bearing posts which provides the reactive forces for allowing the roller to be driven in the reverse direction. During the axial shift of the control shaft, there is no mutual driving force between the follower prongs on the control shaft and a helical groove because of the way the shaft yields.

In the preferred embodiment, there are push rod means which slide blocking gates in and out of the way on some stop pins that extend radially from the control shaft. Their purpose is to assure that the shaft cannot rotate except at the completion of an axial traverse and that rotation of the control shaft will be limited to 90° steps. The push rod means are actuated or pushed back and forth by end caps on the driver sleeve containing the internal helical grooves.

How the features just mentioned and other features of the invention are implemented will appear in the more detailed description of an illustrative embodiment of the invention which will now be described in reference to the drawings.

DESCRIPTION OF A PREFERRED EMBODIMENT

Figure 5:
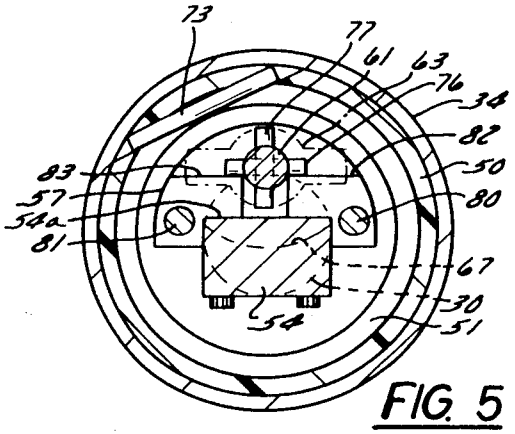
FIG. 5 is a transverse section taken on a line corresponding with 5—5 in FIG. 6.
Figure 1:
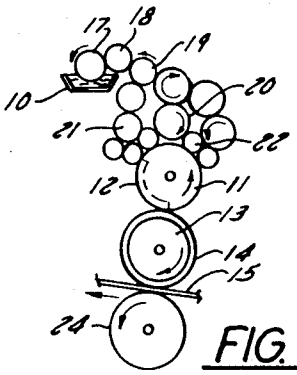
FIG. 1 is a schematic diagram of an abbreviated form of inker comprised of ink transfer rollers and the image plate supporting cylinder, blanket cylinder, and impression cylinder which comprise an offset printing press and in which one or more of the improved axially oscillating ink rollers may be used.

FIG. 1 is a diagram showing, among other things, the arrangement of rollers for transferring printers ink from a reservoir 10 to a printing plate cylinder 11 in one color stage of an offset printing press. A photolithographic plate that is mounted on cylinder 11 is depicted in dashed lines and marked 12. The object of the invention is to assure that a thin uniform coat of ink is applied to image plate 12. The blanket cylinder 13 is contiguous with the plate cylinder 11 and has its periphery encased in a rubber sleeve or mat 14 as typical of offset printing presses. As cylinders 11 and 13 rotate, image plate 12 periodically makes an impression on the outer surface of mat 14 and this impression is transferred to the top of paper web 15 that is passing through the press at high speed while the web is pressed against the blanket cylinder by an impression roller 24.

In FIG. 1, as is typical in offset printing presses, a plurality of rollers whose peripheries are in tangential contact with each other are used to transfer the viscous and greasy ink from reservoir 10 to the printing plate 12. Some of the rollers may have outer cylinders whose peripheries are metal and are highly polished and others may have rubber coated peripheries. The first roller in the series is the ink pick-up roller 17 which, as a result of rotating in the ink reservoir 10, becomes heavily coated with printer's ink. Most of the ink is squeezed off by a swinging ductor roller 18 which is thereby coated with a film of ink. A thin coating of ink is, of course, deposited on the next roller 19 which brings about an exchange of ink with other rollers until it arrives at the image plate cylinder 11.

Selected ones of the ink rollers are oscillated axially as they roll on the roller in which they are in contact. The new oscillating mechanism may be incorporated in rollers 20 and 21, for example. The form roller 22, that is, a roller that transfers ink directly to the image plate 12, may also be oscillating.

The new axially oscillating roller that is adapted for very high speed presses and its self-contained oscillating mechanism will now be described in greater detail in reference to FIGS. 2 and 3 primarily after which its normal operating sequence will be described in reference to FIGS. 2–9.

Figure 2:
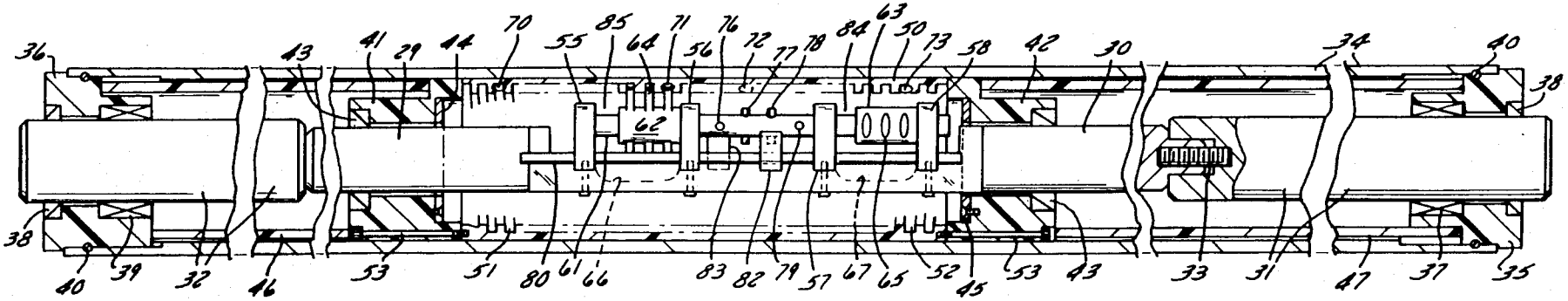
FIG. 2 is a vertical longitudinally extending section of the new axially oscillating ink roller for high speed presses.

Refer first to FIG. 2. The roller assembly comprises a fixed or non-rotating central shaft section 30 which is coupled to an extension shaft 31 on its right end and another extension shaft 32 on its left end. The total length of the three shaft sections is about equal to the length of the shafts that support the other rollers. Shaft sections 31 and 32 span substantially across the width of the press and are clamped to the press by means that are not shown. Thus, shaft sections 30–32 do not rotate. The extension shaft sections 31 and 32 are coupled to central section 30 by means of stud bolts 33. The axially reciprocable roller assembly of FIG. 2 includes an outer cylindrical sleeve 34 whose outer peripheral ink coated surface may be highly polished metal or coated with rubber, not shown. In any event, rotational force is imparted to ink roller cylinder 34 by having it be in contact with a roller in the inker that is receiving driving force through one or more rollers which are power driven rotationally. The mechanism for driving the other rollers is not shown.

Opposite ends of roller cylinder 34 are equipped with roller support means in the form of bearing caps 35 and 36 which may be several feet apart. Typical support cap 35 has a central bore, which in the preferred embodiment, has a needle-type roller bearing 37 fitted into the bore. A shaft seal 38 may also be provided. End cap 36 also a needle-type roller bearing 39. The bearings permit outer cylindrical ink roller 34 to rotate on stationary shaft sections 31 and 32 and to translate axially along the shafts, that is, rotate and shift in one axial direction and then in the reverse axial direction automatically. Typical bearing end cap 35 and the roller cylinder 34 near its inside end, are each grooved to accommodate an O-ring 40 which retain the bearing caps 35 and 36 in cylinder 34. There is another pair of caps 41 and 42 which rotate and are free to slide axially on stationary shaft section 30. These caps are preferably made of a plastic material such as nylon to minimize their weight. Typical cap 41 has a lubricant seal 43 since the space between end caps 41 and 42 may be filled or nearly filled with a lubricant such as grease. The end caps each have metal facing disks 44 and 45 whose purpose will be explained later. There is a spacer tube 46, preferably of a light weight material such as plastic, extending between inside cap 41 and bearing cap 36 and another spacer tube 47 extending between inside cap 42 and bearing cap 35. In the midsection of the roller, there is a cylindrical driver sleeve generally designated by the reference numeral 50. The interior of driver sleeve 50 is provided to the left of its mid-line with a left hand helical groove or thread marked 51. It is also provided with an internal helical groove or right hand thread 52 extending from its mid-line to the right end. The left hand thread could be switched to the right end and the right hand thread could be switched to the left end of the driver sleeve 50, since the mechanism is completely symmetrical and is indifferent to whether it rotates in one direction or the other about its axis. Being adapted for rotation at full speed in either direction is one of the improvements in the ink roller under discussion. The internally helically grooved drive member or sleeve 50 is connected inside cap members 41 and 42 by means of machine screws that are marked 53 in FIG. 2. Thus, the internally grooved drive member 50 and the caps 41 and 42 translate in opposite axial directions together along with outside cylindrical ink roller 34 and spacers 47. The part of typical bearing cap 35 in which bearing 37 is mounted is flat on opposite vertical sides and the end of typical spacer tube 47 is slotted to fit on said part so the spacer sleeve will not rotate. Of course, bearings 37 and 39 shift axially on shaft sections 31 and 32, respectively.

The cylindrical drive member 50 is preferably made of a material that has a low coefficient of friction. A resin such as nylon containing graphite could, for example, be used for the sleeve-like drive member 50. In an actual embodiment, nylon impregnated with molybdenum sulphide comprises drive member 50.

Figure 4:
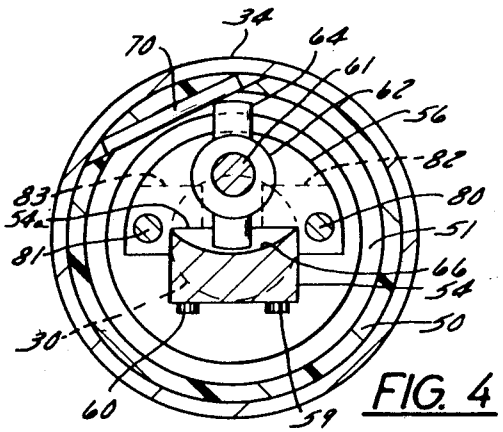
FIG. 4 is a transverse section taken on a line corresponding with 4—4 in FIG. 7.

Stationary shaft sections 29 and 30 are round in cross section. However, the part 54 of the shaft between cylindrical or round sections 29 and 30 is rectangular in cross section and, as can be seen in FIG. 4, flat on top 55. There are four bearing posts 55, 56, 57 and 58 secured to rectangular shaft section 54 by means of socket headed screws such as those marked 59 and 60 in FIG. 4. As can be seen in FIG. 4, the tops of the bearing posts are semi-circular and concentric to the inside diameter of the helical groove 51 so there is clearance between the rotating driver sleeve 50 and the bearing posts.

Figure 3:
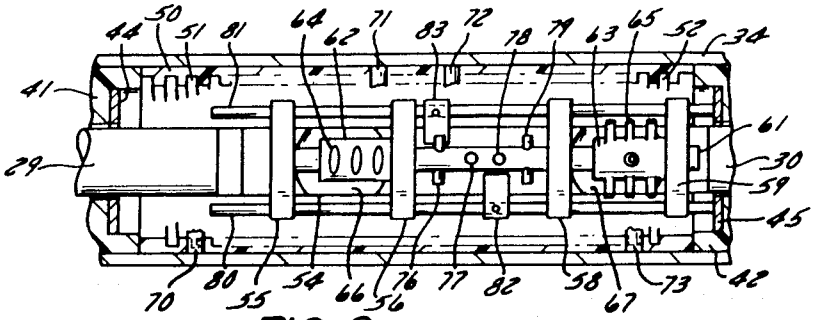
FIG. 3 is a plan view, partly in section, of the central part of the ink roller of FIG. 2 which contains the reversible oscillator drive mechanism.

As shown in FIGS. 2 and 3, a control shaft 61 is supported for rotation in the four bearing posts 55–58. As will be explained, the control shaft rotates in 90° steps when the roller assembly is in operation. The control shaft 61 is also movable axially by a small amount, particularly, depending on the design, through a distance equal to one or two pitch distances between the convolutions of the helical grooves. One pitch distance has been found satisfactory. In this example, the pitch of the left hand helical grooves 51 and 52, respectively, are equal so the roller will shift axially at the same rate in both directions. A pair of follower members 62 and 63 are fastened on control shaft 61 in the positions shown in FIGS. 2 and 3. Follower 62 has groups of three diametrically opposite prongs 64. Follower 63 has groups of diametrically opposite prongs 65. The prongs 65 on follower 63 are displaced rotationally by 90° relative to the prongs 64 on follower 62. In FIGS. 2 and 3 prongs 64 on follower 62 are presently engaged in the left hand helical grooves 51 of the drive member 50 and the prongs 65 of follower 63 are presently disengaged from right hand helical grooves 52 in the driver member 50. As was the case in prior U.S. Pat. No. 4,509,426, assuming that the roller is rotating clockwise as viewed from its right end, when prongs 64 on follower 62 are engaged with the left hand helical groove or thread 51, the ink roller will translate axially to the right. At the right limit of its travel, control shaft 61 is caused to rotate 90° so as to disengage the prongs 64 on follower 62 from the left hand helical groove 51 and to engage the prongs 65 on follower 63 in the right hand helical groove 52. In the patented design, concurrent disengagement of one follower from its mating helical groove and engagement of the other follower with its mating helical groove resulted in instantaneous reversal in direction of the axial movement of the roller. Because the mass of the parts is low, tolerable shock and impact occurs in low speed presses. In high speed presses the abrupt reversal of axial movement imparted significant shock to the system and this portends shorter life. How the autoreversing axially oscillating ink roller design is improved by bringing about shock free reversals in accordance with the invention will be explained in detail as soon as the rest of the parts of the reversing mechanism are identified.

First of all, note that the rectangular mid-section 54 of the main supporting shaft is recessed as at 66 so there is clearance for prong 64 on follower 62 when the follower rotates. Likewise, there is a recess 67 that provides clearance for rotation of follower prong 65.

In FIG. 2, the three prongs 64 of one of the followers 62 are disengaged from its mating left hand helical groove 51 while the three prongs 65 on the other follower 63 are engaged with its mating right hand helical groove 52, and vice versa, by means of four striker pins 70, 71, 72 and 73. The location of the striker pins can be seen in FIGS. 10 and 6–9. One of the striker pins 70 is depicted in FIG. 4. Note that it is arranged on a chord of a circle which is slightly smaller in radius than the radius of the prongs 64. Thus, if the roller is assumed to be operating in a counterclockwise direction as viewed in FIG. 4, it will be evident that striker pin 70 will exert a wiping or cam-like action on the tip of one of the prongs 64 so as to encounter the prong at an angle without a perpendicular impact force, that is, the striker pin makes a gentle angular contact with the prong and stays in contact with it for a significant amount of prong rotation so that the follower prong rolls over smoothly. The two axially innermost strikers 71 and 72 of the four strikers are involved with rotating the control shaft 61 and followers at opposite ends of the rollers axial travel when the roller is turning in a counterclockwise direction as viewed from the right end in FIG. 2. The two axially outermost strikers 70 and 73 are involved in rotating the followers in and out of engagement with their mating helical grooves when the ink roller is rotating clockwise as viewed from its right end in FIG. 2. Of course, in any press, any of the ink rollers will always run in the same direction when the press is in production. However, as will be shown, the mechanism operates in a symmetrical fashion so that if the new reversing roller is retrofit into an existing press, it will not make any difference as to which is the right end and which is the left end since the roller reversing mechanism allows the roller to operate equally well in either direction of rotation.

The various figures show that there are four stop pins 76, 77, 78 and 79 whose opposite ends extend radially outwardly from axially slidable control shaft 61. These pins are provided to assure that the control shaft 61 is constrained against rotating until the moment when it should rotate and engage one group of follower prongs while it is disengaging the other group. There are two pusher rods 80 and 81 mounted in the four bearing blocks 70–73 for sliding in opposite axial directions within limits. There are blocking means called gates 82 and 83 fixed on pusher rods 80 and 81, respectively. Assuming that the ink roller is rotating clockwise as viewed from its right end in FIGS. 2 and 3, it will be observed, particularly in FIG. 3, that the tendency of the control shaft to rotate clockwise, if any, would be blocked only by stop pin 76 striking against stop gate 83. All other stop pins 77, 78 and 79 are doing nothing at the moment. It will be evident that stop gates 82 and 83 will have to be positioned axially at the right times to permit control shaft 61 rotation and to prevent control shaft 61 rotation. This is done by the control that the mechanism exercises over the push rods 80 and 81. Stop pins 76 and 77 are involved in blocking rotation of tghe control shaft 61 when the roller is driven clockwise as viewed from the right end and stop pins 78 and 79 block control shaft rotation at appropriate times during counterclockwise rotation.

At this juncture, it is desirable to observe an important novel characteristic of the mechanism. It is that the control shaft 61 is free to slide axially by a limited amount in either direction and then to come up against stops which, in this case, are the bearing posts. In this particular design, the control shaft 61 is allowed to shift bidirectionally a distance equal to one pitch of the helical grooves in the roller driver member 50. Note, for instance in FIG. 2, the gap 84 between follower body 63 and bearing post 57 and the gap 85 between follower body 63 and bearing post 58. The gaps are about equivalent in width to one pitch of the helical drive member grooves 51 and 52 and the control shaft 61 can move axially by this amount in one direction and return by the same amount in the other direction. As will be explained, letting the control shaft 61 shift axially provides for a lost motion or axial dwell of the roller which permits the axially reversible roller to make an idle revolution, that is, a revolution wherein no axial motion occurs immediately after the follower prongs are rotated into engagement which, according to the prior art, would change axial direction with a snap action and without delay. The dwell provided substantially eliminates inertial impact.

An operational cycle of the axially reciprocating roller will now be described. Assume that the roller 34 and internal helically grooved driver member 50 are positioned at the beginning of a cycle as they are in FIG. 2. Assume that the roller is rotating clockwise as viewed from its right end and, of course, counterclockwise from its left end. Control shaft 61 and the roller are presently shifted to their rightmost limits. The roller 34 had been driven to the right limit because a moment ago right hand follower prongs 65 were engaged in right hand helical grooves or thread 52. Both push rods have been pushed to their left limit by reason of the end cap wear plate 45 having pushed the right tips of the push rods to the left as the roller shifted to the left. Immediately after the push rods had moved to the left, striker 73 located in the right hand helical groove 52, had struck the rightmost prong 65 on follower 63, thereby causing follower shaft 61 to rotate counterclockwise as viewed from its left end. This action caused the axial outermost follower prong among the three prongs identified by 65 to disengage from the right hand helical groove 52 and the left follower prongs 64 to engage with the left hand helical groove 51 as shown. The roller is now ready to shift left. As soon as the follower prongs 64 engaged with the left hand helical groove 51, in accordance with the originally patented design, the ink roller would have started to shift to the right. This abrupt change in axial direction would impart some shock force to the system which was tolerable at what might be called low roller rotational speeds, but would be expected to result in a shortened life in the modern high speed web presses. In accordance with the invention, the shock is greatly reduced and the transition of roller movement from one axial direction to the opposite direction is made smooth by letting the roller make at least one revolution at the end of each axial traverse before driving the roller in the opposite axial direction is begun. This is done by letting the control shaft yield axially to prevent axial movement of the roller and then stop the control shaft so the roller can advance on its helical grooves.

Observe in FIG. 2 that followers 62 and 63 are stopped up against bearing blocks 56 and 58. Roller control shaft 61 and the followers are at their rightmost limit in the stage of an operating cycle depicted in FIGS. 2 and 3. Since control shaft 61 is free to move through a distance limited by the followers striking the bearing posts, the former engagement of right hand helical groove 52 with the follower prongs 63 would have caused the control shaft 61 to yield to the right by the reactive forces between the prongs and helical groove 52 as the roller was driven to the left. Now, with the roller at its leftmost limit and rotating counterclockwise from its left end, the continuously rotating roller would tend to turn onto the left prongs 64 and advance to the right analogous to a nut advancing to the right on a left hand threaded bolt.

Figure 6:
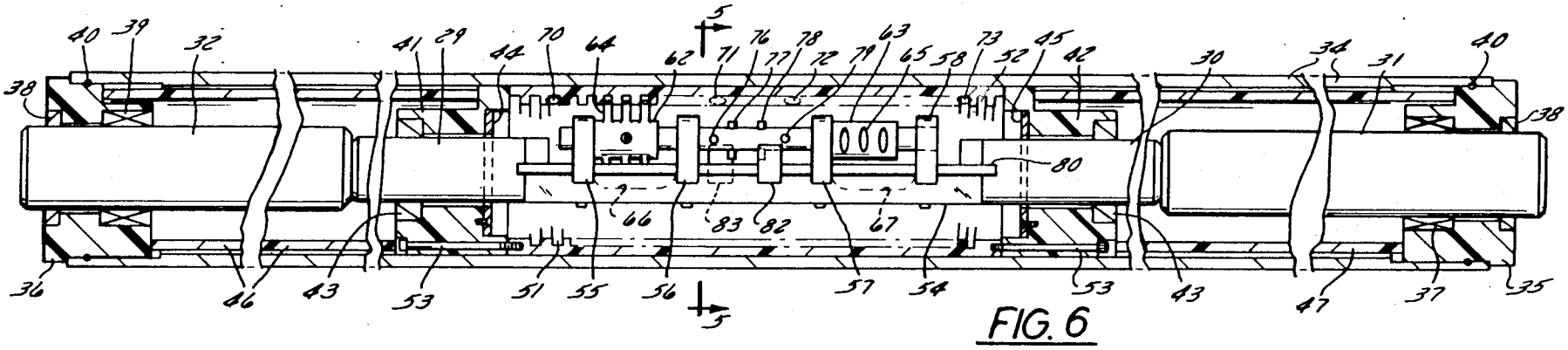
FIGS. 6–9 taken in conjunction with FIGS. 2 and 3, show the sequence of states that the roller drive mechanism goes through to execute a cycle involving shifting the roller from its limit in one axial direction to its limit in the other axial direction and then bringing about the actions that cause the roller to idle and then start to drive back to its beginning position.

In accordance with the invention, what happens next is evident in FIG. 6. In this figure, one may see that the reactive forces resulting from the left helical groove turning on left follower prongs 64 have caused follower shaft 61 to yield to the left while the roller is continuing its rotation. Stop pin 76 has slid along gate 83 but this gate is still blocking the control shaft against turning counterclockwise as viewed from this left end. Yielding of the control shaft 61 prohibits the roller from advancing axially. In other words, the roller dwells without axial movement for at least one roller revolution between shifting axially in one direction and beginning to shift axially in the reverse direction. It has been found that letting the control shaft 61 shift by the amount of one pitch of the helical convolutions in the driver member so as to allow one idle revolution at the end of each axial traverse is all that is needed to effect a smooth shock free reversal in the axial travel of the roller.

Assume now that the free play in control shaft 61 is taken up and followers 62 and 63 on control shaft 61 are stopped against bearing posts 55 and 57. Now, the roller begins to drive to the right. Stop pin 76 is bearing on stop gate 83 to prevent rotation of the control shaft. After the roller makes its idle revolution, it begins to advance to the right as would be the case in FIG. 6 because control shaft 61 cannot shift anymore.

Figure 7:
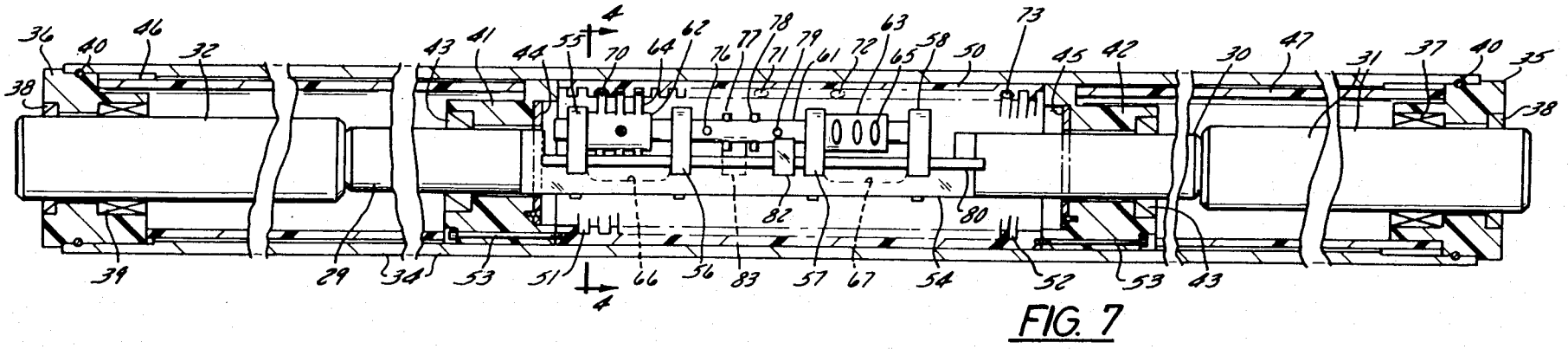

In FIG. 7, the roller is shown in the state wherein it is advanced axially to the right sufficiently for the wear plate 44 on left end support 41 to be driven into contact with the push rods 80 and 81 which are compelled to move in unison. The parts are related so that push rods 80 and 81 are shifted to the right in FIG. 7 by an amount equal to about one helical convolution or thread pitch. This causes stop gates 82 and 83 to shift right and move the pins to a position where 90° of revolution of the control shaft 61 is allowed. In other words, the control shaft is unblocked at this moment. Immediately after the push rods 80 and 81 are pushed the distance of about one helical convolution pitch, left striker pin 70 rolls onto the leftmost follower prong 64, thereby forcing the follower shaft 61 to rotate 90° in the direction of rotation of the roller. Now, the roller is at its right limit of axial travel and the left follower prongs 64 are disengaged from the left hand helical groove 51 and the right hand follower prongs 65 are engaged with the right hand helical groove 52. Stop gate 83 in particular is in a position to clear stop pin 76 to block stop pin 77 as depicted in FIG. 8.

Figure 8:
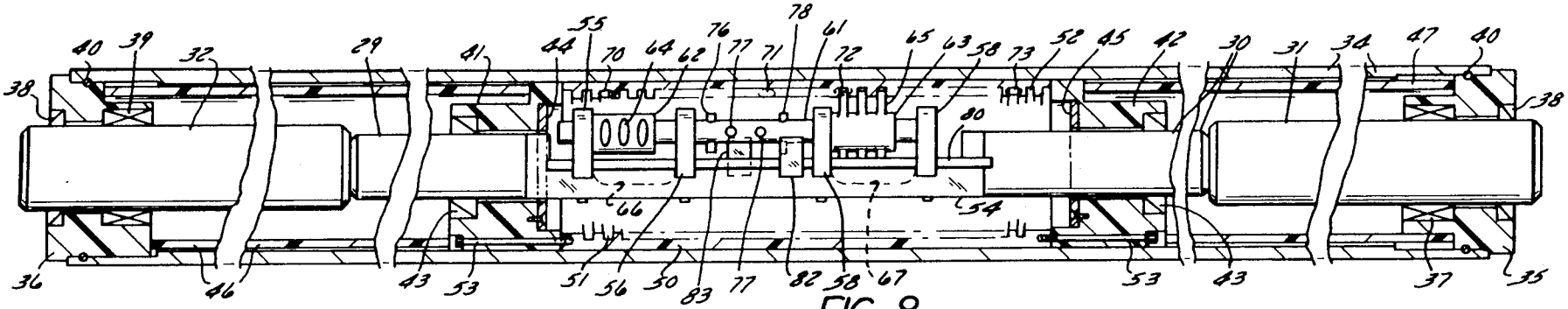
Figure 10:
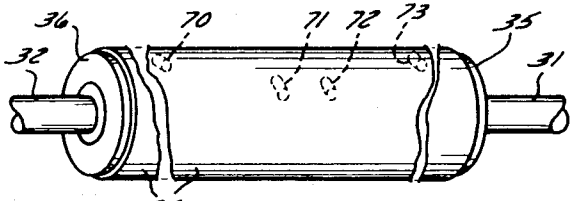
FIG. 10 is a foreshortened view of the roller presented to provide a better understanding of the location of the striker elements that bring about axial reversal of the roller.

FIG. 8 shows that immediately after control shaft 61 is turned 90°, the control shaft still has free play to the right. There is a gap between followers 62 and 63 and bearing posts 56 and 57 respectively. Now, with follower prongs 65 engaged with the right hand helical groove 52 and the roller rotating clockwise as viewed from its right end, the roller is caused to dwell for one revolution by reason of the fact that control shaft 61 yields to the right when the right hand helical thread 52 attempts to screw onto the follower prongs 65 for the roller to move left.

Figure 9:
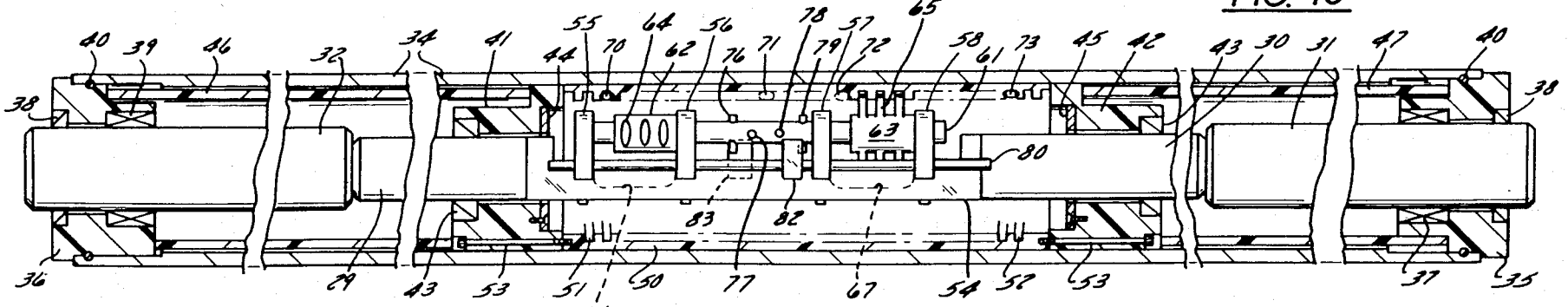

In FIG. 9, control shaft 61 has shifted to its right limit and the roller can now start moving to the left by reason of the right hand helical groove 52 being engaged with follower prongs 65. In FIG. 9, the gate 83 is still blocking by reason of pin 77 being driven against it. Here it may be noted that stop pins 76–79 in the control shaft 61 are arranged such that they will be effective to stop against the stop gates 82 and 83 at a point on the stop gate which will allow them to be in a stopping position after the control shaft is shifted to take up its endwise free play.

Continuing with inspection of FIG. 9, it will be evident that now the roller will start driving to the left. When it is near its left limit wear plate 45 on end support 42 will abut push rods 80 and 81 simultaneously and shift stop gates 82 and 83 to the left, thus freeing the control shaft 61 for rotation. Immediately after push rods 80 and 81 are shifted, right outermost striker pin 73 will strike the rightmost prong 65 on follower 63 and cause shaft 61 to turn clockwise as viewed from its right end to thereby bring about engagement of left prongs 64 in left hand twist helical groove 51. This returns the roller to the state in which it is exhibited in FIG. 2 wherein it is about to make the one idle revolution and dwell in its axial movement before starting to shift to the right again.

In the description thus far, it has been assumed that the roller is being driven rotationally clockwise as viewed from its right end in the drawings. In such case, striker pins 70 and 73 nearest to the outside ends of the helically grooved driver sleeve 50 are active in striking the outermost follwer prongs in the groups 64 and 65 respectively, to cause rotation of the control shaft 61 at the right and left limits, respectively, of roller axial travel. An important feature of the improved roller is that it can be installed without being concerned about which is the proper direction of rotation for it since the improved roller can operate in either direction of rotation equally well.

Assume that the roller is being driven rotationally counterclockwise now as viewed from its right end. In this case, the inner pair of striker pins 71 and 72 will perform the follower rotation function. The follower pins 71 and 72 are slanted in driver 50 oppositely of the follower pins 70 and 73 to bring about the smooth wiping or rolling action of the striker pins on the tips of the follower prongs 64 and 65 that was described earlier in connection with clockwise rotation of the roller. Consider, for example, FIG. 9 and assume that the roller is now turning counterclockwise as viewed from its right end. In such case, the right hand helical groove 52 would be backing off of the prongs 65. In other words, the roller would be shifting to the right. Eventually, the inside striker pin 72 would strike the innermost of the prongs in the group 65 and cause these prongs 65 to rotate out of engagement with the right hand helical groove 52 and the prongs 64 to engage with the left hand helical groove 51. Before that, gate 82 would have been pushed to where it would be clear of stop pin 78 and allow 90° of rotation of shaft 61 but now stop pin 79 would block rotation beyond 90°. When the roller shifts axially to its left limit, the other inside striker pin 71 would strike the innermost prong in the group of prongs 64 to disengage the follower prongs from the left hand helical groove 51. In counterclockwise rotation, only control shaft stop pins 78 and 79 are needed. Only stop gate 82 is involved in counterclockwise rotation. As in the opposite rotation case, the sequence is for the push rods to shift the gates until one control shaft pin is no longer obstructing and the next adjacent pin is in position to arrest control shaft rotation when a stricker pin cams one follower to rotate 90° for disengaging one follower and engaging the other one. Then there is at least one roller revolution during which the control shaft yields axially while the roller stays stationary axially. After the one revolution, the control shaft is blocked axially and the engaged helical groove can then turn one or screw off of a follower.

It will be seen that the axial travel distance of the roller is governed by the location of the striker pins 70 and 73 for clockwise rotation and striker pins 71 and 72 for counterclockwise rotation if the roller is viewed from its right end. Generally, the axial oscillation range of the roller will be at least 1" but oscillations as great as 4" may be used in some cases.

I claim:

1. An ink roller adapted for rotating and oscillating in opposite axial directions comprising:

non-rotating shaft means for being mounted to a printing press, a cylindrical ink roller journaled for rotating and sliding in opposite axial directions on said shaft, a generally cylindrical driver member inside of said roller and rotatable therewith and means in said member defining first and second coaxial and adjacent helical grooves surrounding said non-rotating shaft, the twist of the convolutions of one helical groove being opposite of the twist of the other, support means mounted to said non-rotating shaft and a control shaft mounted for rotation on said support means about an axis parallel to the rotational axis of the ink roller cylinder, follower members at axially spaced apart locations on said control shaft, each follower member having pairs of diametrically opposite radially extending follower prong means, the prong means on one follower member being angularly displaced about the axis of the rotatable control shaft relative to the other such that the prong means on one follower member will engage with a cooperating helical groove whose convolutions are twisted in one direction while the prong means on the other follower member are disengaged from the oppositely twisted helical groove so that when said roller is driven rotationally the engaged helical groove will turn on the prong means on the other follower member and drive said roller axially in one direction, means for rotating said control shaft to disengage said prong means on one follower member from a helical groove having one twist when said roller has shifted axially by a predetermined distance and engage the prong means on the other follower member with the groove having the opposite twist so the roller is driven axially in the opposite direction, and the improvement wherein:

said rotatable control shaft is shiftable in axially opposite directions on said support means, between limits, the reactive forces between one helical groove that twists one way and its cooperating follower prong means when said roller is rotating in one direction being such as to cause said control shaft to shift to one limit in the direction opposite to the axial direction in which said roller is being driven such that when said means for rotating said control shaft means rotates said control shaft at the time said roller reaches a predetermined axial limit the other follower prong means engages in the other helical groove that twists opposite to said one way and said other helical groove and roller rotate freely for at least one revolution during which the reactive forces are such as to cause said control shaft to shift until it stops at the other limit before said roller will reverse its axial movement direction.

2. The ink roller according to claim 1 including a disc fixed to each end of said cylindrical driver member for rotation about the roller axis, one push rod means mounted to said non-rotating shaft for sliding in opposite axial directions, blocking gate means mounted to said push rod means, said blocking gate means being proximate to said control shaft and movable along said control shaft, one pair of stop pin means extending radially outward from said control shaft and angularly displaced from each other by 90°, rotation of said control shaft to disengage one follower prong means and engage the other causing one of said pin means to rotate and strike said blocking gate means to block said shaft against rotational overtravel, movement of said driver member in the direction resulting from engagement of said other follower prong means causing one of said discs to push said rod means and shift said gate means such that said one pin means will be clear of said gate means and the other pin means will be aligned with said gate means to arrest rotation of said control shaft.

3. The ink roller according to claim 2 including:

second push rod means mounted to said non-rotating shaft for sliding in opposite axial directions in parallelism with said one push rod means, blocking gate means mounted to said second push rod means in proximity to said control shaft and movable along said control shaft, a second pair of stop pin means extending radially outward from said control shaft and angularly displaced from each other by 90°, rotation of said control shaft to disengage said other follower prong means and engage said one follower means causing said stop pin means to rotate and strike said blocking gate means to block said control shaft against overtravel, moving said driver member in the direction resulting from engagement of said one follower prong means causing the other of said discs to push said rod means and shift the gate means on said second push rod means such that one stop pin means in said second pair will be clear of said gate means on said second push rod means and the other pin means will be aligned with said second gate means to arrest rotation of said control shaft.

4. The ink roller according to claim 1 wherein said means for rotating said control shaft when said ink roller has shifted axially a predetermined distance in either direction and said roller is being driven rotationally in one direction of rotation comprises:

a striker element located in each helical groove of opposite twist near corresponding most axially remote ends of the grooves, said elements consisting of rods arranged in said driver means as a chord of a circle for engaging said prong means generally tangentially to the circle through which said prong means rotate.

5. The ink roller according to claim 4 wherein said means for rotating said control shaft when said ink roller has shifted axially a predetermined distance in either direction and said roller is being driven rotationally in a direction opposite of said one direction comprises:

a striker element located in each helical groove of opposite twist near corresponding most axially inward ends of the grooves, said elements consisting of rods arranged in said driver means as a chord of a circle for engaging said prong means generally tangential to the circle through which said prong means rotate.

6. The ink roller according to claim 1 wherein said support means on which said control shaft is mounted constitute said stop means for setting the limits of axial shifting by said control shaft and it is the follower members on said control shaft that abut said stop means.

7. The ink roller according to claim 1 wherein said driver member is comprised of a lightweight plastic material.

8. The ink roller according to claim 1 wherein said driver member is comprised of nylon containing molybdenum sulphide.

9. The ink roller according to claim 1 wherein each follower member comprises a body fastened to said control shaft and each prong means are constituted by a first plurality of prongs extending from the body radially from one side of the control shaft and a corresponding second plurality of prongs extending from the opposite side of the control shaft.

* * * * *